US009206976B1

(12) United States Patent
McDermott

(10) Patent No.: US 9,206,976 B1
(45) Date of Patent: Dec. 8, 2015

(54) LIGHT EMITTING DIODE (LED) LIGHTING DEVICE WITH HEAT SINK

(71) Applicant: Kevin McDermott, Rockledge, FL (US)

(72) Inventor: Kevin McDermott, Rockledge, FL (US)

( * ) Notice: Subject to any disclaimer, the term of this patent is extended or adjusted under 35 U.S.C. 154(b) by 0 days.

(21) Appl. No.: 14/802,918

(22) Filed: Jul. 17, 2015

Related U.S. Application Data

(63) Continuation-in-part of application No. 14/242,154, filed on Apr. 1, 2014, now Pat. No. 9,121,556.

(51) Int. Cl.

| | |
|---|---|
| ***F21L 4/00*** | (2006.01) |
| ***F21V 29/70*** | (2015.01) |
| ***F21V 19/00*** | (2006.01) |
| ***F21V 17/10*** | (2006.01) |
| ***F21K 99/00*** | (2010.01) |
| ***F21V 23/04*** | (2006.01) |
| ***F21V 23/06*** | (2006.01) |
| ***F21V 17/16*** | (2006.01) |

(52) U.S. Cl.
CPC ..... *F21V 29/70* (2015.01); *F21K 9/1355* (2013.01); *F21L 4/005* (2013.01); *F21V 17/101* (2013.01); *F21V 17/166* (2013.01); *F21V 19/002* (2013.01); *F21V 19/004* (2013.01); *F21V 23/0414* (2013.01); *F21V 23/06* (2013.01)

(58) Field of Classification Search
CPC ..... F21L 4/00; F21L 4/005; F21V 29/70
USPC ..... 362/190, 191, 202, 206
See application file for complete search history.

(56) References Cited

U.S. PATENT DOCUMENTS

| | | | | |
|---|---|---|---|---|
| 7,631,984 | B2 * | 12/2009 | Martin et al. | F21L 4/027 362/202 |
| 2007/0109775 | A1 | 5/2007 | Chen | |
| 2011/0019395 | A1 | 1/2011 | Malkoff | |

* cited by examiner

*Primary Examiner* — David V Bruce
(74) *Attorney, Agent, or Firm* — Hauptman Ham, LLP

(57) ABSTRACT

A light emitting diode (LED) lighting device including a circuit configured to energize a surface mount LED lamp having an integral LED heat sink with a source of power. The LED lighting device further includes a printed circuit board having a first side, a second side and a metallic thermal connector extending from the first side to the second side. The surface mount LED lamp is attached to the first side with the LED heat sink in contact with the metallic thermal connector. The LED lighting device further includes a fixture configured to hold the printed circuit board and position a metallic heat sink on the second side of the printed circuit board in contact with the metallic thermal connector.

20 Claims, 8 Drawing Sheets

AX
LL
2D
11
20
8
10
HEO
9
2
2B
2A
FX
SL
B1P, B1PP
1, F
B1
B1N
FX
B2P, B2PP
B2
B2N
5
FX
HEC

11
LL
2D
20
10
8A
HEO
9
2
2B
2A
B1P, B1PP
1, F
B1
B1N
B2P, B2PP
B2
B2N
5
HEC

LIGHT EMITTING DIODE (LED) LIGHTING DEVICE WITH HEAT SINK

CROSS-REFERENCE TO RELATED APPLICATIONS

The present application is a continuation-in-part of U.S. patent application Ser. No. 14/242,154 filed on Apr. 1, 2014, which is entirely incorporated by reference herein.

BACKGROUND

The present description relates to a light emitting diode (LED) lighting device having a heat sink and a surface mount LED lamp.

Light emitting diode (LED) light sources are susceptible to damage by excessive heat buildup. Surface mount LED light sources are energized at high power levels which increases an amount of heat generated. In some approaches, surface mount LED light sources include a heat sink located such that when the LED is mounted on a printed circuit (PC) board the heat sink contacts the PC board permitting terminal energy to flow from the LED to reduce the temperature of the LED.

A PC board is usually small which limits the amount of heat energy that the PC board can absorb. In addition, PC boards can have high thermal resistance reducing their ability to transfer heat energy to adjacent components or heat sinks. Also heat transfer to an adjacent heat sink depends upon the thermal contact resistance between components such as the adjacent heat sink and the PC board. The thermal contact resistance can be excessive if components are not pressed against each other-do not have intimate contact. Unfortunately it is possible for components to be near each other but have poor contact such that heat transfer is limited. Finally heat transfer to adjacent components depends upon the surface contact area between the components and the distance between components. As the distance between the heat sink and the LED increases or as the surface area between components decreases the heat transfer is reduced. Therefore in many products heat transfer from the LED is inadequate due to minimal surface area or an unacceptably large distance between heat transfer components.

SUMMARY

An LED lighting device having an LED light source having an internal heat sink mounted on a first side of a printed circuit contacting a metallic thermal connector for transferring heat from the LED light source to a metallic heat sink on a second side of the printed circuit board. The metallic heat sink is in close proximity to the LED and pressed against the metallic thermal connector to minimize the thermal resistance of the thermal circuit for maximizing the transfer of heat away from the LED light source.

BRIEF DESCRIPTION OF THE DRAWINGS

One or more embodiments are illustrated by way of example, and not by limitation, in the Figures of the accompanying drawings, wherein elements having the same reference numeral designations represent like elements throughout.

DETAILED DESCRIPTION

Figure 1:
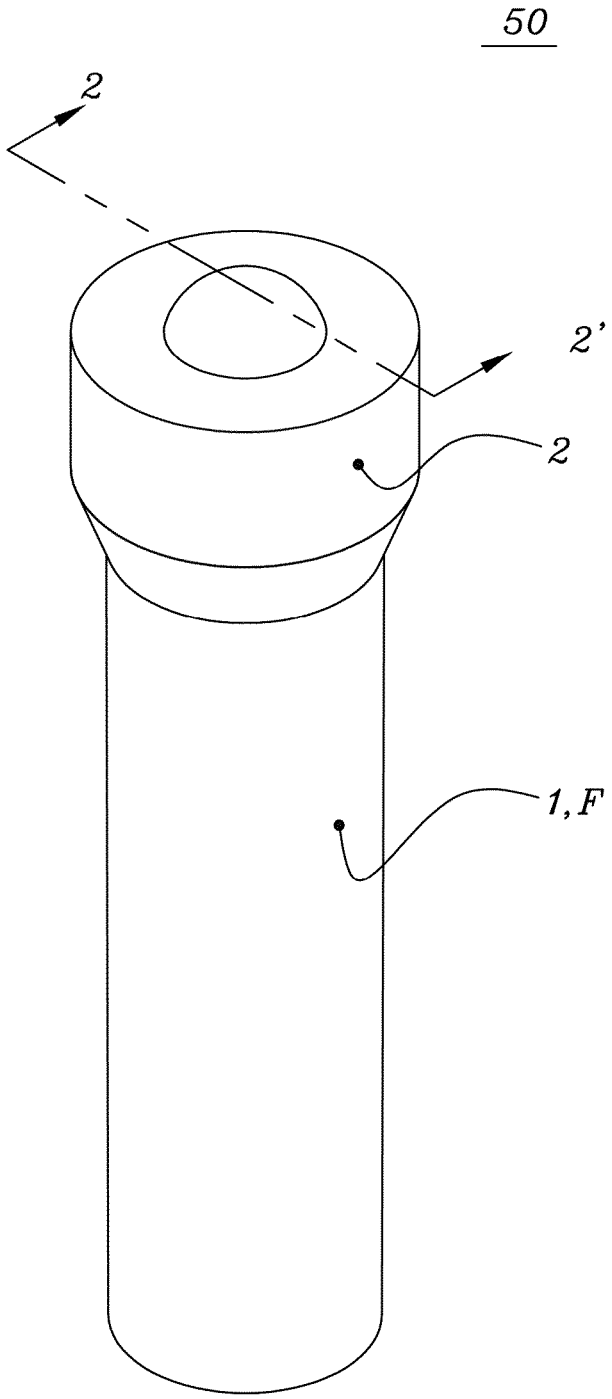
FIG. 1 is a perspective view of a lighting device according to some embodiments.

FIG. 1 is a perspective view of a lighting device 50 according to some embodiments. Lighting device 50 includes a fixture F having a housing 1 and a retainer 2.

Figure 2:
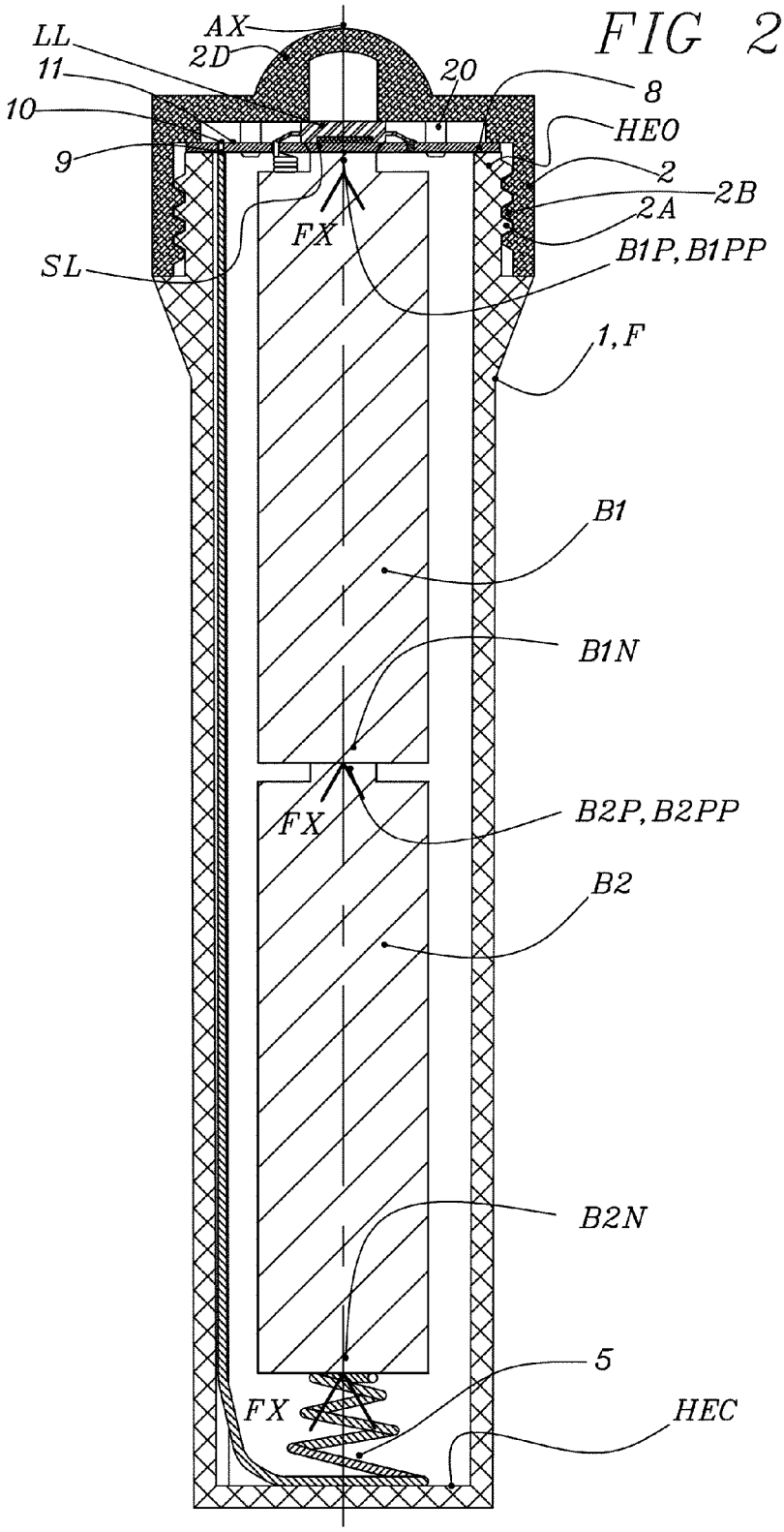
FIG. 2 is a cross-sectional view taken across line 2-2' of FIG. 1 according to some embodiments.

FIG. 2 is a cross sectional view taken across line 2-2' of FIG. 1 according to some embodiments. Housing 1 has a tubular configuration including a housing end closed HEC and a housing end open HEO with a battery one B1 and a battery two B2 installed. In some embodiments, the two batteries B1 and B2 are AA size batteries. In some embodiments, lighting device 50 includes one or more batteries or employs a variety of battery configurations. Although the drawings and description regarding lighting device 50 includes two discrete batteries as a source of power for the LED, one of ordinary skill in the art would recognize that the term battery should be interpreted to mean either a single battery or a plurality of batteries to energize an LED lamp LL. Retainer 2 includes a threaded internal surface 2B for engaging a threaded external surface 2A of housing 1.

Figure 3:
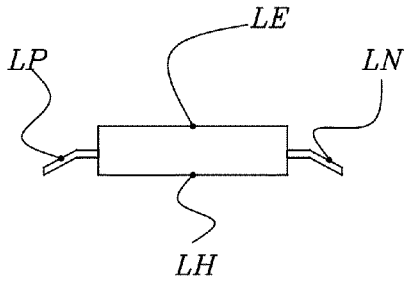
FIG. 3 is a side view of a light emitting diode (LED) lamp according to some embodiments.

FIG. 3 is a side view of LED lamp LL according to some embodiments. LED lamp LL includes an LED positive terminal LP, an LED negative terminal LN, an LED emitter surface LE and an LED heat sink LH. In some embodiments, LED lamp LL is part number LR W5SN-JYKY-1Z manufactured by OSRAM™ or any other suitable LED lamp.

Figure 4:
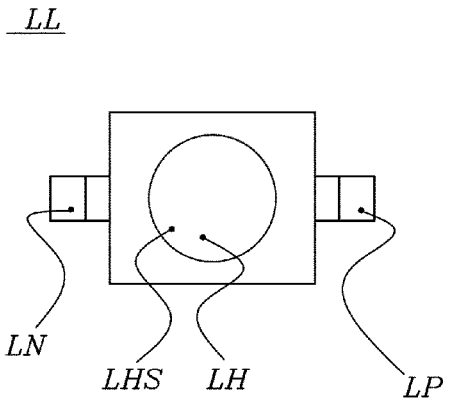
FIG. 4 is a bottom view of an LED lamp according to some embodiments.

FIG. 4 is a bottom view of LED lamp LL according to some embodiments. LED heat sink LH is between LED positive terminal LP and LED negative terminal LN and has a heat sink surface area LHS.

Figure 5:
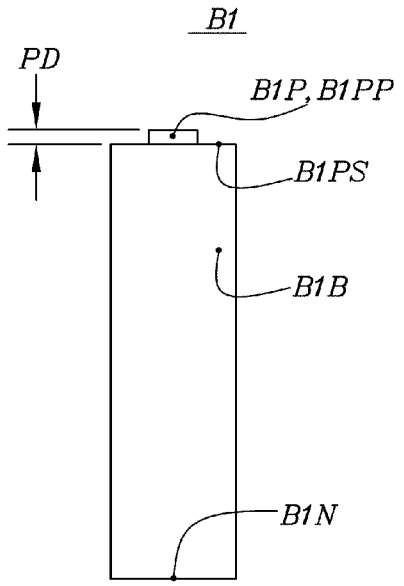
FIG. 5 is a side view of a battery according to some embodiments.

According to some embodiments FIG. 5 is a side view of battery one B1 according to some embodiments. Battery one B1 is an AA battery with a metallic shell capable of functioning as a metallic heat sink. Battery one B1 includes a positive end having a positive terminal B1P including a battery one positive protrusion B1PP and a battery one positive surface B1PS which are a single metal component and electrically connected. Either battery one positive protrusion B1PP or battery one positive surface B1PS is able to be used as a positive connection for battery one B1. Battery one positive projection B1PP extends a protrusion distance PD from a battery one body B1B. Battery one B1 also includes a negative end having a negative terminal B1N. Battery two B2 similarly includes a positive end having a positive terminal B2P including a battery two positive protrusion B2PP and a negative end having a negative terminal B2N (FIG. 2). In some embodiments, battery one B1 and battery two B2 are placed in a series connection with negative terminals facing housing end closed HEC and with positive terminals facing housing end opened HEO of housing 1. A spring 5 is a compression spring placed between battery two negative terminal B2N and housing end closed HEC. Spring 5 is additionally configured to contact and exert a force on battery two negative terminal B2N pushing battery two B2 towards LED lamp LL. Spring 5 extends along an inner longitudinal wall of housing 1 to contact a bottom side 8B (FIG. 6) of a printed circuit board 8 at lower contact pad 9 and plated through switch hole 10.

Figure 6:
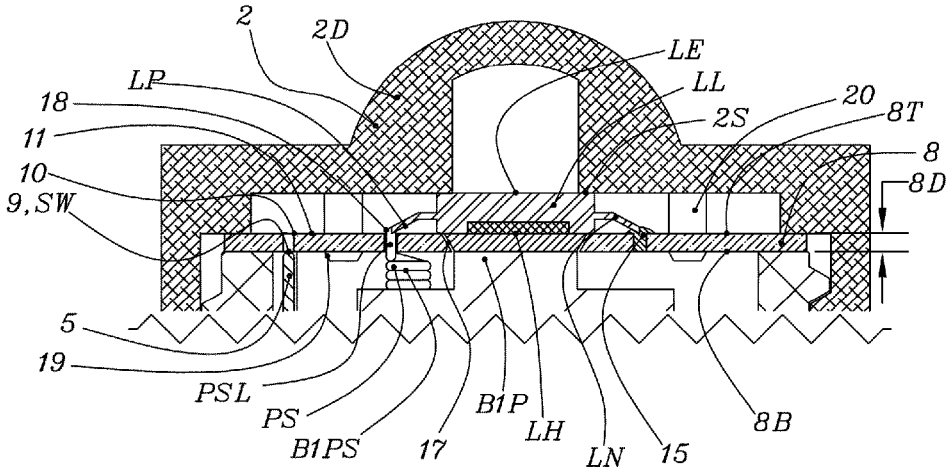
FIG. 6 is an enlarged view of a top portion of FIG. 2.

FIG. 6 is an enlarged view of a top portion of FIG. 2. According to some embodiments spring 5 contacts printed circuit board 8 and conducts electricity from negative terminal B2N of battery two B2 to lower contact pad 9 and plated through switch hole 10. Since switch through hole 10 is plated, the switch through hole conducts electricity to a top side 8T of printed circuit board 8 where the electricity is conducted by an upper surface pad 11 to LED negative terminal LN. According to some embodiments upper surface pad 11 intersects LED negative terminal LN and is soldered at that junction to help assure electrical connection. In some embodiments, printed circuit board 8 also includes a thickness 8D and a plated through negative hole 15 which is located at or adjacent to LED negative terminal LN. According to some embodiments plated through negative hole 15 substantially increases the structure which anchors and secures LED lamp LL to printed circuit board 8 as solder fills plated through negative hole 15 and connects to LED negative terminal LN. This additional structure helps to assure that LED lamp LL is not displaced from printed circuit board 8.

According to some embodiments fixture F comprises battery one positive protrusion B1PP in intimate contact with metallic thermal connector SL which is in intimate contact with LED heat sink LH of LED lamp LL. Spring 5 creates a force FX pressing battery one B1 and battery two B2 towards metallic thermal connector SL which is—in turn—towards LED heat sink LH of LED lamp LL according to some embodiments. Battery one B1 and battery two B2 have limited movement because LED heat sink LH exerts a counter force on metallic thermal connector SL which exerts a counter force on the batteries at battery one positive protrusion B1PP. Hence, spring 5 maintains battery one positive protrusion B1PP pressed against metallic thermal connector SL and metallic thermal connector SL pressed against LED heat sink LH. According to some embodiments this pressed against relationship—intimate contact—helps maximize heat transfer from LED lamp LL to battery one B1.

Spring 5, battery one B1, battery two B2, metallic thermal connector SL and LED heatsink LH all are disposed along axis AX of battery one B1 effecting an arrangement which minimizes the distance heat must travel and maximizes the heat transfer from LED heat sink LH according to some embodiments.

According to some embodiments, as retainer 2 is tightened onto external surface 2A of housing, spring 5 is compressed to effect spring force FX. According to some embodiments of lighting device 50 which do not include spring 5, as retainer 2 is tightened onto external surface 2A of housing 1, a force similar to spring force FX is created in that battery one B1 is pressed with battery two B2 towards metallic thermal connector SL.

Printed circuit board 8 also includes a plated through positive hole 18 located under or adjacent to LED positive terminal LP. According to some embodiments positive compression spring PS includes leg PSL passing through printed circuit board 8 at plated through positive hole 18. Leg PSL is soldered within plated through positive hole 18 and also soldered to LED positive terminal LP. Positive compression spring PS extends towards battery one B1 where the positive compression spring contacts battery one positive surface B1PS thereby completing circuit C (FIG. 9) for energizing LED lamp LL with battery one B1 and battery two B2. In some embodiments, LED lamp LL includes LED heat sink LH electrically connected to LED positive terminal LP and the LED lamp energizing circuit C is completed as battery one positive protrusion B1PP contacts the LED heat sink. In some embodiments, LED lamp LL is part number LR W5SN-JYKY-1Z manufactured by OSRAM™ and includes a heat sink electrically connected to LED positive terminal LP and positive spring PS is not necessary to energize LED lamp LL. Battery one B1 is a source of electrical power, a metallic heat sink and a conductor for energizing circuit C and LED lamp LL. Battery two B2 is a source of electrical power, a metallic heat sink and a conductor for energizing circuit C and LED lamp LL In some embodiments, heat sinks are not the source of electrical power or a conductor energizing circuit C and positive spring PS energizes LED lamp LL.

According to some embodiments spring 5 is pushing battery one B1 and battery two B2 against LED lamp LL and the resulting force FX sufficient to lift a contact pad or a track attaching LED lamp LL to printed circuit board 8 and separate LED lamp LL from printed circuit board 8, according to some embodiments. Plated through positive hole 18 and plated through negative hole 15 are each one of several similar plated through holes which act as anchors for countering force FX from spring 5 for maintaining LED terminals and ultimately LED lamp LL securely attached to printed circuit board 8, in some embodiments.

Retainer 2 is molded of a transparent plastic and threaded onto housing 1 such that when the retainer is tightened spring 5 at housing end opened HEO makes contact with lower contact pad 9 thereby closing circuit C and energizing LED lamp LL, in some embodiments. Conversely when retainer 2 is loosened the retainer rotates lower contact pad 9 away from a top of spring 5, opens circuit C and de-energizes LED lamp LL. Hence, lower contact pad 9, retainer 2 and spring 5 cooperate to form switch SW. Therefore, circuit C includes battery one B1, battery two B2, LED lamp LL switch SW for selectively de-energizing or energizing LED lamp LL. According to some embodiments retainer 2 is additionally contoured to provide retainer or lamp support 2S on retainer dome 2D to support and deter LED lamp LL from moving away from or being separated from printed circuit board 8 due to the forces developed by spring 5, in some embodiments.

Removing heat from LED lamp LL decreases a temperature of the LED lamp and therefore increases the luminous efficacy of the lamp. The heat which flows into battery one B1, which functions as a metallic heat sink, warms the battery. In cold environments batteries fail to function properly, in some instances. Therefore, warming battery one B1 improves the ability of battery one B1 to provide energy in cold environments.

Figure 7:
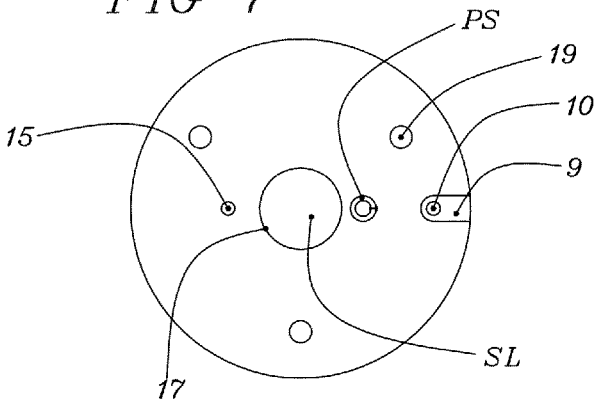
FIG. 7 is a bottom view of printed circuit board 8 according to some embodiments.

FIG. 7 is a bottom view of printed circuit board 8 according to some embodiments. FIG. 7 includes printed circuit board mount hole 19 employed to secure printed circuit board 8 to retainer 2. According to some embodiments a mount pin 20 (FIG. 6) passes through mount hole 19 and is glued in position to secure printed circuit board 8 to retainer 2. FIG. 7 shows through hole 17 of printed circuit board 8 occupied by metallic thermal connector SL.

Figure 8:
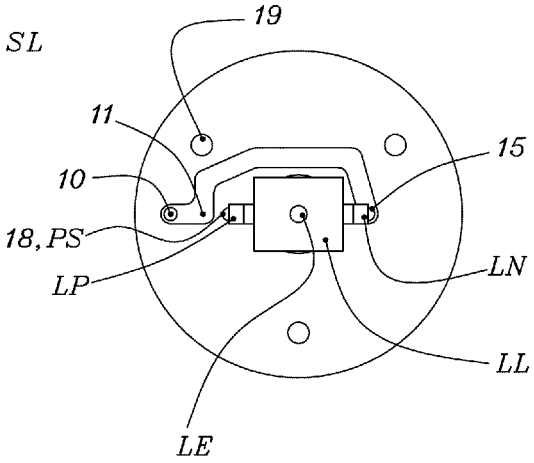
FIG. 8 is a top view of a printed circuit board 8 according to some embodiments.

FIG. 8 is a top view of printed circuit board 8 according to some embodiments. According to some embodiments printed circuit board 8 includes LED negative terminal LN of LED lamp LL soldered to upper surface pad 11 and plated through negative hole 15. Printed circuit board 8 also includes LED positive terminal LP soldered to plated through positive hole 18 and to positive spring PS.

Figure 9:
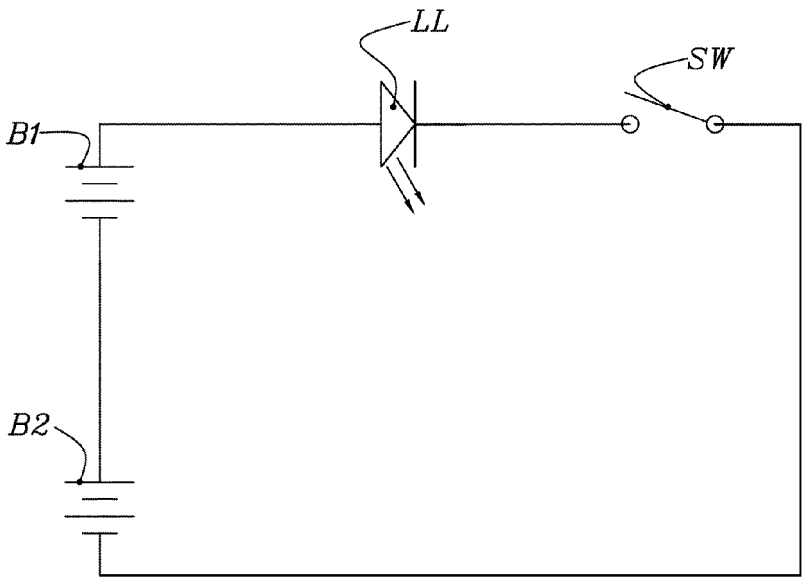
FIG. 9 is a schematic diagram of a circuit for energizing an LED lamp according to some embodiments.

FIG. 9 is a schematic diagram of circuit C employing battery one B1 and battery two B2 in series for energizing an LED lamp according to some embodiments.

According to some embodiments of the present disclosure a light emitting diode (LED) lighting device 50 including circuit C is configured to energize a surface mount LED LL lamp having an LED heat sink LH with a source of power Battery one B1. The LED lighting device further includes a printed circuit board 8 having a first side and a second side. According to some embodiments the surface mount LED lamp LL is attached to the first side with the LED heat sink LH contacting metallic thermal connector SL which extends from the first side to the second side. Lighting device 50 is configured to hold printed circuit board 8 and position metallic heat sink (battery one B1) on the second side contacting metallic thermal connector SL. According to some embodiments spring 5 creates a force FX pushing battery one B1 against metallic thermal connector SL which transmits the force and pushes against LED heat sink LH maximizing the transfer of heat between the LED heat sink and metallic heat sink. According to some embodiments, heat flows from the LED heat sink through the metallic thermal connector and into the metallic heat sink.

According to some embodiments, metallic thermal connector SH is trapped between LED heatsink LH and printed circuit board 8; however since metallic thermal connector SH is not attached to either component, it transmits the spring 5 force FX to LED heat sink LH creating an intimate connection between the spring 5 and the LED heat sink LH and maximizing the heat transfer between the spring 5 and the LED heat sink LH.

According to some embodiments a light emitting diode (LED) lighting device is configured to energize a surface mount LED lamp having an LED heat sink, wherein the circuit comprises a source of power having a metallic heat sink.

Figure 10:
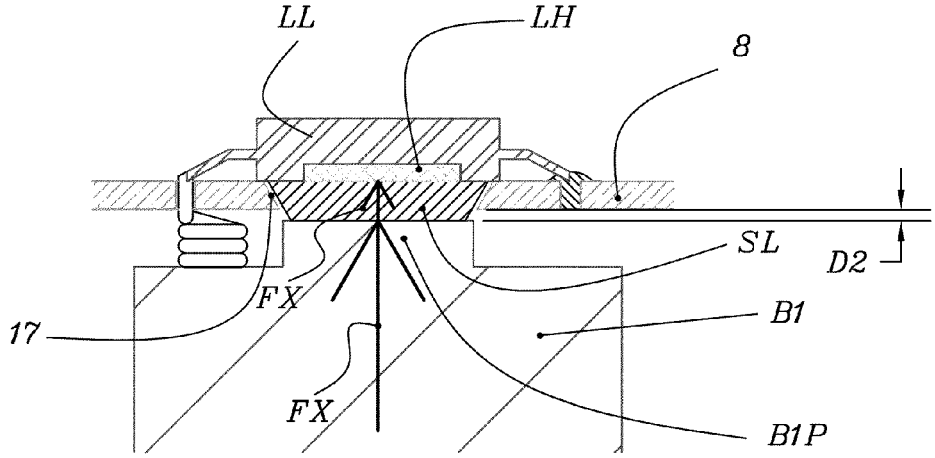
FIG. 10 is an enlarged view of a central portion of FIG. 6.

FIG. 10 is an enlarged view of the central portion of FIG. 6 according to some embodiments of the present disclosure. FIG. 10 shows disc shaped metallic thermal connector SL having tapered sidewalls disposed in tapered through hole 17 (opening) of printed circuit board 8. LED lamp LL is soldered to printed circuit board 8 on top of metallic thermal connector SL with LED heat sink LH contacting metallic thermal connector SL according to some embodiments. Therefore LED lamp LL prevents metallic thermal connector SL from separating from the top side 8T of printed circuit board. The presence of LED lamp LL above metallic thermal connector SL traps metallic thermal connector SL between LED lamp LL and printed circuit board 8. The matching tapered walls of tapered through hole 17 and metallic thermal connector SL prevent metallic thermal connector SL from falling through through hole 17 and separating from the bottom side 8B of printed circuit board 8, according to some embodiments, because a minimum diameter of through hole 17 is larger than the maximum diameter of metallic thermal connector SL according to some embodiments. Metallic thermal connector SL is configured to extend distance D2 below printed circuit board 8 whereat metallic thermal connector SL is in contact with battery one positive terminal B1P. According to some embodiments metallic thermal connector SL extends distance D2 below printed circuit board 8 assuring that batteries and/or heat sinks having a positive battery terminal without a protrusion or batteries having negative terminals not having a protrusion are reliably connected to circuit board 8 with minimal electrical and/or thermal resistance.

According to some embodiments printed circuit board 8 has a thickness 8D of 0.062 inches and distance D2 is 0.006 inches making the distance between the LED heat sink and the metallic heat sink—the heat transfer path—approximately 0.072 inches. According to some embodiments minimizing this dimension of the heat transfer path beneficially improves the heat transfer. According to some embodiments the heat transfer path should be less than 0.5 inches.

Figure 11:
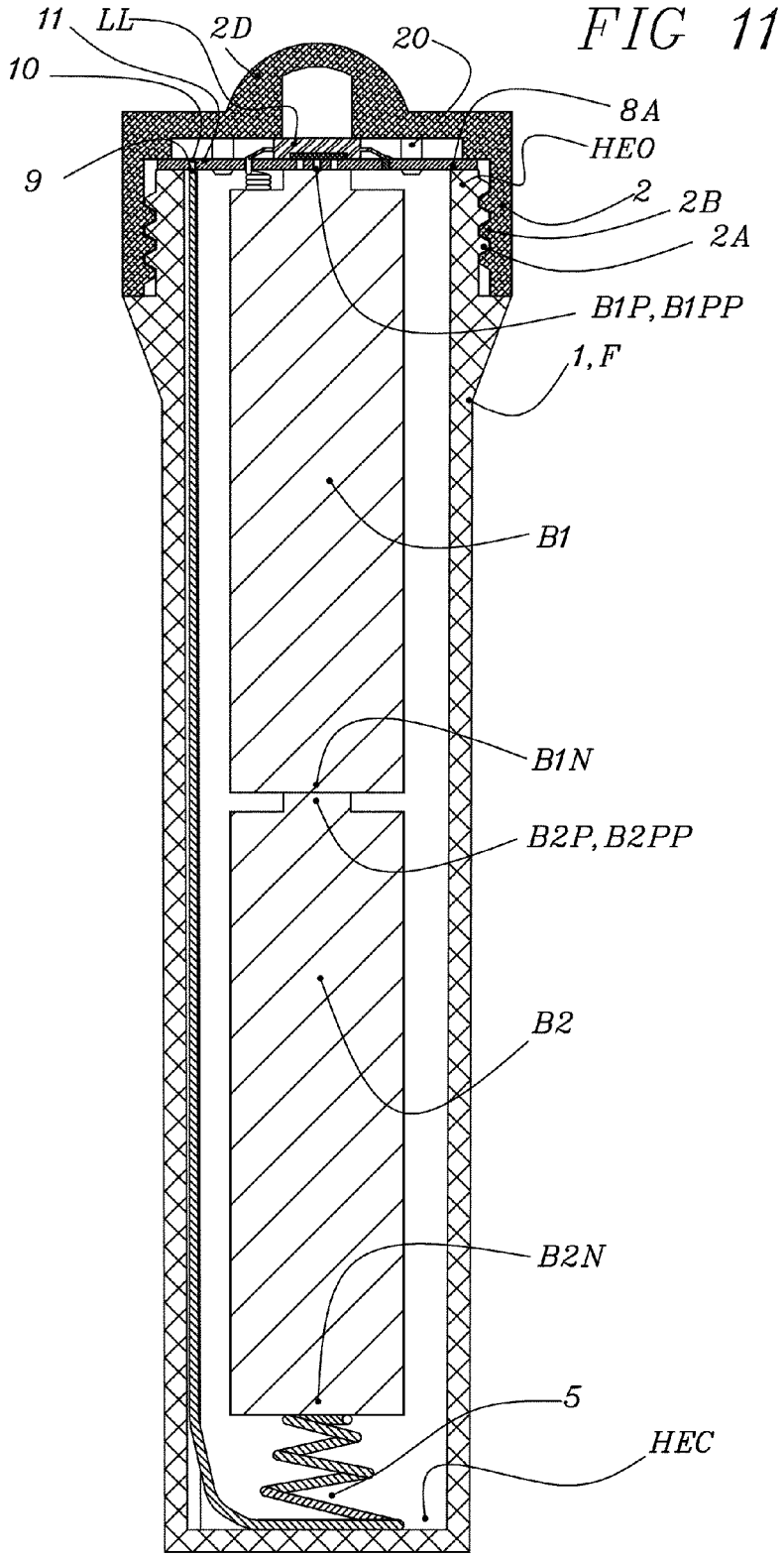
FIG. 11 is a cross-sectional view of an alternate embodiment of the present disclosure taken across line 2-2' of FIG. 1 according to some embodiments.
Figure 12:
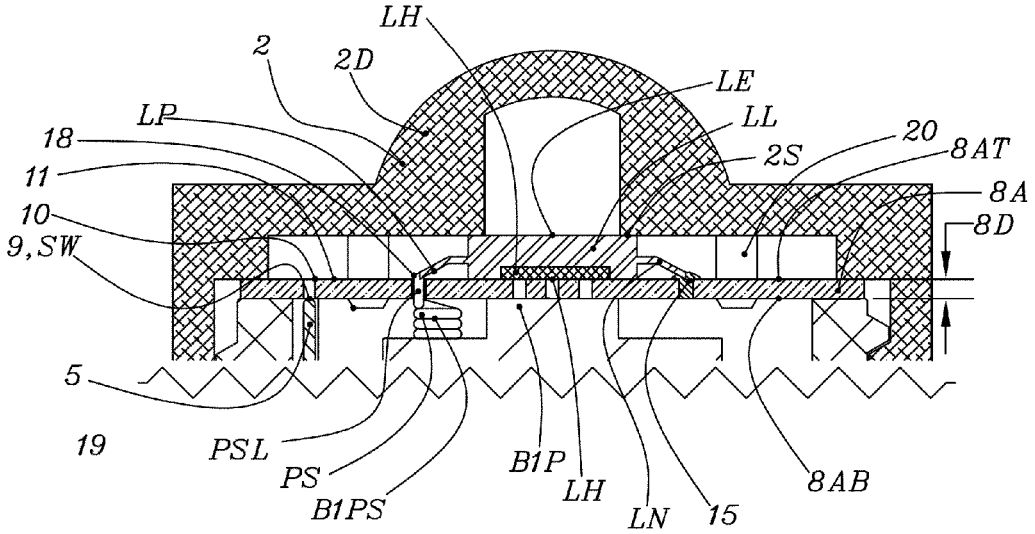
FIG. 12 is an enlarged view of a top portion of FIG. 11.

FIG. 11 is a cross-sectional view of an alternate embodiment of the present disclosure taken across line 2-2' of FIG. 1 according to some embodiments. FIG. 12 is an enlarged view of a top portion of FIG. 11 and FIG. 13 is an enlarged view of a central portion of FIG. 12.

Figure 13:
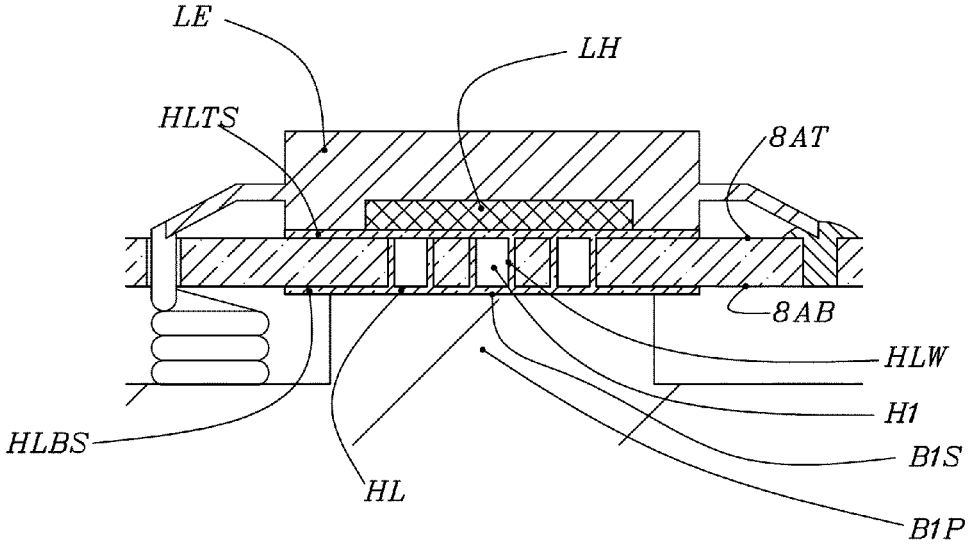
FIG. 13 is an enlarged view of a central portion of FIG. 12.

FIGS. 11, 12 and 13 describe an alternate embodiment of the present disclosure. This alternate embodiment is similar to that shown in FIGS. 2, 6 and 10 except printed circuit board 8 has been replaced with printed circuit board 8A, according to some embodiments. Metallic thermal connector SL has been replaced with metallic thermal connector HL which is a thermal connector of printed circuit board 8A.

Figure 14:
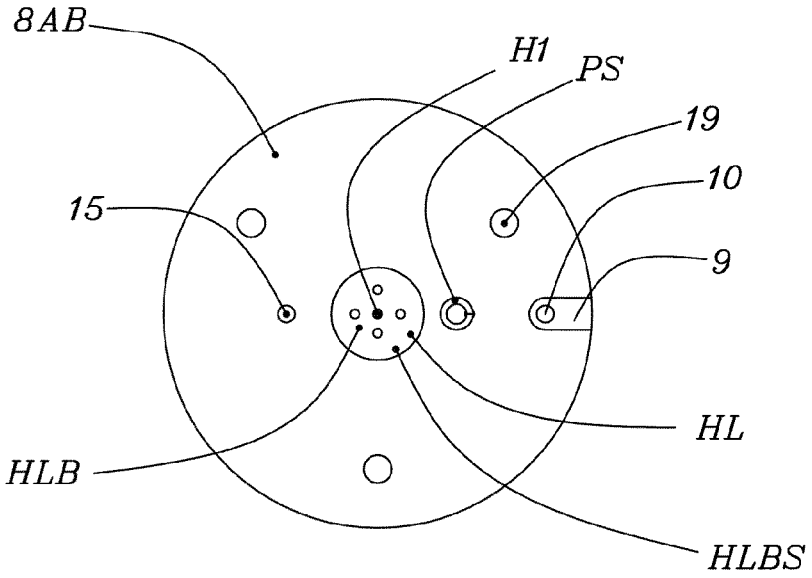
FIG. 14 is a bottom view of printed circuit board 8A from FIG. 12 according to some embodiments.
Figure 15:
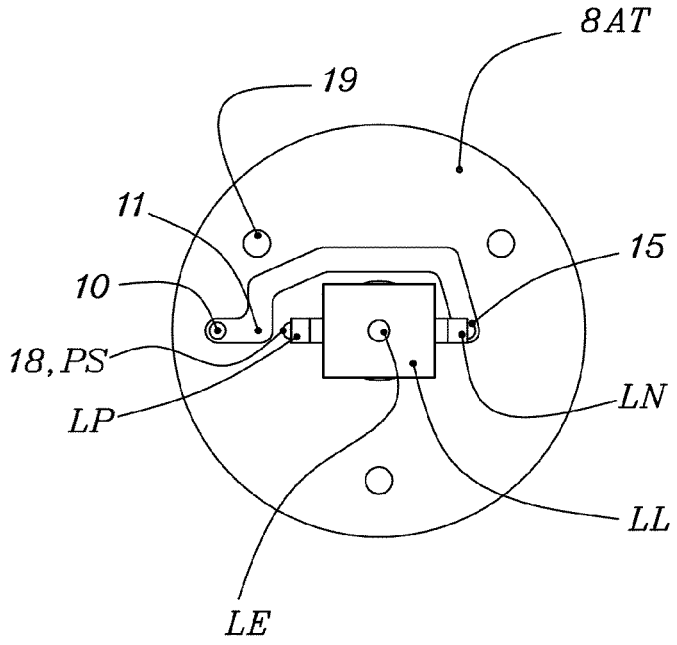
FIG. 15 is a top view of printed circuit board 8A from FIG. 12 according to some embodiments.

FIG. 14 is a bottom view of printed circuit board 8A from FIG. 12 according to some embodiments. FIG. 15 is a top view of printed circuit board 8A from FIG. 12 according to some embodiments and it is identical to previously described FIG. 8. According to some embodiments printed circuit board 8A includes LED negative terminal LN of LED lamp LL soldered to upper surface pad 11 and plated through negative hole 15. Printed circuit board 8 also includes LED positive terminal LP soldered to plated through positive hole 18 and to positive spring PS.

FIG. 14 is similar to previously described FIG. 7 except through hole 17 is not provided and metallic thermal connector SL is replaced by metallic thermal connector HL according to some embodiments. According to some embodiments metallic thermal connector SL is a component separate from printed circuit board 8. According to some embodiments metallic thermal connector HL is permanently connected to printed circuit board 8A. Looking at FIGS. 13 and 14 circuit board 8A comprises metallic thermal connector HL comprising at least one plated through hole H1 extending from printed circuit board top 8AT to printed circuit board bottom 8AB. Plated through hole H1 is equal to any plated through opening. Typically in some embodiments there are a plurality of plated through holes. According to some embodiments FIG. 14 shows a plurality plated through holes similar to plated through hole H1. According to some embodiments a plated through hole is a hole which has its internal walls coated by plating or other means with a conductive metal. According to some embodiments the plated through holes when viewed from circuit board bottom 8AB are surrounded by a circular metallic bottom plateau HLB which comprises a copper layer 2 to 6 thousands of an inch thick and a bottom plateau surface area HLBS. A similar circular metallic top plateau HLT surrounds the plated through holes on circuit board top 8AB according to some embodiments. Plated through hole H1 comprises interior walls having a metallic layer HLW extending from metallic top plateau HLT to metallic bottom plateau HLB forming both electrical and thermal circuits having low resistance according to some embodiments.

According to some embodiments printed circuit board 8A is constructed of aluminum and a central portion of that aluminum printed circuit board is metallic thermal connector HL.

According to some embodiments in order to improve the transfer of heat away from the LED LL the circular metallic top plateau HLT must have a top plateau surface area HLTS at least equal to the surface area of LED heat sink LH as shown in FIG. 4. According to some embodiments in order to improve the transfer of heat away from the LED LL the circular metallic bottom plateau HLB must have a bottom plateau surface area HLBS at least equal to the surface area of battery one projection B1S as shown in FIG. 13.

According to some embodiments in order to accommodate available LED components battery one B1 and battery two B2 are placed in FIG. 11 with battery one negative BIN be against circuit board 8A. According to some embodiments the absence of a battery protrusion pressed against the PC board presents a problem in that adequate electrical and thermal contact could not be guaranteed. According to some embodiments circular metallic bottom plateau HLB solves this problem by comprising the thickness necessary to assure that the flat negative terminal of the battery makes electrical contact.

According to some embodiments increasing the quantity of plated through holes on the PC board also beneficially increases the flow of heat and beneficially reduces the temperature of the LED thermal connector. According to some embodiments the plated through holes on the PC board can be filled with metal or solder to beneficially increase the flow of heat and beneficially reduce the temperature of LED thermal connector LE. According to some embodiments a single enlarged plated through hole filled with solder or an alternate metallic substance can provide adequate heat transfer.

According to some embodiments the metallic thermal connector includes a first metallic pad on the first side and a second metallic head on the second side of the PC board with at least one but frequently a plurality of plated through holes on the PC board connecting the two metallic pads. The first metallic pad increases the surface contact area between the LED heat sink and the metallic thermal connector and the second metallic pad increases the surface contact area between the metallic heat sink and the metallic thermal connector. Increasing the surface contact area increases the flow of heat and beneficially reduces the temperature of the LED thermal connector.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A light emitting diode (LED) lighting device comprising:

a circuit configured to energize a surface mount LED lamp having an LED heat sink with a source of power;

a printed circuit board having a first side and a second side, a metallic thermal connector extending from said first side to said second side through an opening in said printed circuit board, said surface mount LED lamp attached to said first side, with said metallic thermal connector pressed against said LED heat sink; and a fixture holding said printed circuit board with a heat sink on said second side, said fixture effecting a force pressing said heat sink against said metallic thermal connector and pressing said metallic thermal connector against said LED heatsink.

2. The LED lighting device according to claim 1, wherein said fixture includes a spring for effecting said force.

3. The LED lighting device according to claim 1, wherein said fixture additionally comprises an LED lamp support configured to deter movement of said LED lamp away from said printed circuit board.

4. The LED lighting device according to claim 1, wherein said LED lamp is solder bonded to said printed circuit board at a location on said printed circuit board having through holes for anchoring said LED lamp to said printed circuit board.

5. The LED lighting device according to claim 1, wherein said source of power comprises a battery and said battery is said heat sink.

6. The LED lighting device according to claim 1, wherein said LED heat sink and said metallic thermal connector are coaxial.

7. The LED lighting device according to claim 1, wherein said metallic thermal connector is configured not to pass through said opening on said second side of said printed circuit board.

8. The LED lighting device according to claim 1, wherein said LED lamp comprises a negative terminal and a positive terminal, and said LED heat sink is electrically connected to said positive terminal.

9. A light emitting diode (LED) lighting device comprising:

a circuit configured to energize a surface mount LED lamp having an LED heat sink, wherein the circuit comprises a source of power;

a printed circuit board comprising a permanently attached metallic thermal connector extending from a first side of said printed circuit board to a second side of said printed circuit board, said surface mount LED lamp attached to said first side with said LED heat sink contacting said metallic thermal connector; and a fixture holding said printed circuit board with a heat sink on said second side, said fixture effecting a force pressing said heat sink against said metallic thermal connector.

10. The LED lighting device according to claim 9, wherein said metallic thermal connector comprises at least one plated through hole surrounded by a first metallic plateau on said first side and surrounded by a second metallic plateau on said second side.

11. The LED lighting device according to claim 9, wherein said metallic thermal connector comprises at least one plated through hole.

12. The LED lighting device according to claim 9, wherein said source of power is a battery and said battery is said heat sink.

13. The LED lighting device according to claim 9, wherein said metallic thermal connector is a central portion of an aluminum printed circuit board.

14. The LED lighting device according to claim 9, wherein said LED has a negative terminal and a positive terminal, and said LED heat sink is electrically connected to said positive terminal.

15. A light emitting diode (LED) lighting device comprising:

a circuit configured to energize a surface mount LED lamp with a battery, said LED lamp having an LED heat sink;

a printed circuit board having a first side and a second side, a metallic thermal connector extending from said first side to said second side, said surface mount LED lamp solder bonded to said first side with said LED heat sink contacting to said metallic thermal connector;

a fixture having a tubular housing comprising a first housing end and a second housing end, wherein said second housing end is a closed end; and said fixture having a retainer for holding said printed circuit board at said first housing end with said battery on said second side pressing against said metallic thermal connector.

16. The LED lighting device according to claim 15, wherein said circuit comprises a switch for selectively energizing or de-energizing said LED.

17. The LED lighting device according to claim 15, wherein said fixture comprises an LED lamp support configured to deter movement of said surface mount LED lamp away from said printed circuit board.

18. The LED lighting device according to claim 15, wherein said surface mount LED lamp comprises a negative terminal and a positive terminal, and said LED heat sink is electrically connected to said positive terminal.

19. The LED lighting device according to claim 15, wherein said surface mount LED lamp at a location on said printed circuit board having through holes for anchoring said LED lamp to said printed circuit board.

20. The LED lighting device according to claim 15, wherein said circuit additionally comprises a second battery and said fixture additionally holds said second battery on said second side pressing against said battery.

* * * * *